US009668560B2

(12) United States Patent
Lenci et al.

(10) Patent No.: US 9,668,560 B2
(45) Date of Patent: Jun. 6, 2017

(54) CLOSURE DEVICE WITH MAGNETIC INTERLOCKING LOGO

(71) Applicants: Ruggero Lenci, Rome (IT); Giancarlo Lenci, Rome (IT)

(72) Inventors: Ruggero Lenci, Rome (IT); Giancarlo Lenci, Rome (IT)

( * ) Notice: Subject to any disclaimer, the term of this patent is extended or adjusted under 35 U.S.C. 154(b) by 0 days.

(21) Appl. No.: 15/021,777

(22) PCT Filed: Sep. 9, 2014

(86) PCT No.: PCT/IT2014/000239
§ 371 (c)(1),
(2) Date: Mar. 14, 2016

(87) PCT Pub. No.: WO2015/037028
PCT Pub. Date: Mar. 19, 2015

(65) Prior Publication Data

US 2016/0235174 A1 Aug. 18, 2016

(30) Foreign Application Priority Data

Sep. 13, 2013 (IT) ..... RM2013A0505

(51) Int. Cl.
*A41F 1/00* (2006.01)
*A45C 13/10* (2006.01)
(Continued)

(52) U.S. Cl.
CPC ..... *A45C 13/1069* (2013.01); *A41F 1/002* (2013.01); *G09F 3/02* (2013.01); *G09F 23/00* (2013.01)

(58) Field of Classification Search
CPC ..... Y10T 24/32; Y10T 24/1959; Y10T 24/44573; Y10T 24/44632; Y10T 24/45;
(Continued)

(56) References Cited

U.S. PATENT DOCUMENTS 2,615,227 A * 10/1952 Hornik ..... A44C 5/2071 24/303
5,515,581 A * 5/1996 Kaufmann ..... A45C 13/1069 24/303

(Continued)

OTHER PUBLICATIONS

International Search Report, dated Dec. 11, 2014, from corresponding PCT Application.

*Primary Examiner* — David Upchurch
(74) *Attorney, Agent, or Firm* — Young & Thompson

(57) ABSTRACT

Magnetic interlocking closure device made of two main components different one another and frontally-interpenetrating, one "male" and the other "female", in which shapes with complex outlines, such as those of a logo or of the customizable initials of a name, give shape to the "male" and, by subtraction, to the "female", which allows to reversibly hold together two overlapping openable surfaces of materials such as fabric, leather, leather-imitation, cardboard, wood, other materials such as metallic, organic, minerals, ceramics, glass, composites, or a combination of them, which, by way of example, but not as a limitation, may be those of bags, handbags or of other containers such as purses, boxes, sheaths, cases, protective cases, or of pieces of apparel such as jackets, coats, raincoats, trousers, skirts, belts, necklaces, bracelets.

18 Claims, 3 Drawing Sheets

(51) Int. Cl.
*G09F 23/00* (2006.01)
*G09F 3/02* (2006.01)

(58) Field of Classification Search
CPC ..... Y10T 24/45534; Y10T 24/4782; Y10T 292/11; A41F 1/002; A44D 2203/00; A45C 13/1069; A44B 11/258; A44B 11/2592; Y10S 63/90
See application file for complete search history.

(56) References Cited

U.S. PATENT DOCUMENTS 5,987,715 A * 11/1999 Khon ..... A41F 1/002 24/303
6,292,985 B1 * 9/2001 Grunberger ..... A44B 11/2592 24/303
6,647,597 B2 * 11/2003 Reiter ..... A41F 1/002 24/303
6,804,865 B2 * 10/2004 Grunberger ..... A41F 1/002 24/303
8,196,268 B1 6/2012 Placeres
2002/0000024 A1 1/2002 Grunberger
2002/0112323 A1 8/2002 Nire
2003/0131452 A1 7/2003 Revel
2004/0016089 A1 1/2004 Grunberger et al.
2006/0236509 A1 * 10/2006 Ausman ..... A44B 5/02 24/303
2011/0167595 A1 * 7/2011 Fiedler ..... A45C 13/1069 24/303
2011/0167597 A1 * 7/2011 Su ..... A41F 1/002 24/303
2013/0276269 A1 * 10/2013 Su ..... A44B 11/001 24/303
2013/0291347 A1 * 11/2013 Su ..... A44B 11/001 24/303

* cited by examiner

CLOSURE DEVICE WITH MAGNETIC INTERLOCKING LOGO

FIELD OF INVENTION

The present invention relates to a magnetic and interlocking closure device, comprising two components each other interpenetrating, "male-female", which allows to reversibly couple-uncouple two overlapping surfaces of any kind of material generally used for the production of bags and the like, said closure device incorporating in its interlocking mechanism the shape of a distinctive logo such as a trademark, or the initials of a name, which is perfectly visible and recognizable when the device is uncoupled, i.e. open, and when is coupled, i.e. closed.

The field of interest includes all those cases where it is needed to emphasize a complex shape such as a logo and, at the same time, to hold together two overlapping openable surfaces. In the device, the logo gives shape to the "male" component and, by subtraction, to the "female" component resulting in an interacting system, composed of two main elements, a "male" and a "female", different one another and complementary to each other. The logo is clearly visible when the device is open—in both the "male" and the "female"—as well as when the device is closed.

The field of application of the device includes the closure of bags, handbags or other containers such as box files, purses, boxes, sheaths, cases, protective cases, or of pieces of apparel such as jackets, coats, raincoats, trousers, skirts, belts, necklaces, bracelets. The materials of the two overlapping surfaces the device holds in adherence may be fabric, leather, leather-imitation, cardboard, wood, metallic, organic, minerals, ceramics, glass, composites, or a combination of them.

The device achieves the complete incorporation of any logo and/or any combination of letters in a magnetic interlocking closure device, as shown in the attached figures. In those figures, by way of example and not as a limitation, the logo is composed of alphabetic stylized characters, among the possible combinations of numbers, symbols, cryptograms, drawings.

BACKGROUND OF THE INVENTION

The functioning of interlocking closures, of magnetic closures, and of closures based on a combination of those two systems, is well known in the art.

The patent application in Italy for the invention 0001325146 titled "*Chiusura magnetic con interaggancio mutuo, per borse, zaini, capi di abbigliamento e simili*", also filed in the US with the title "Magnetic closure with mutual interlocking system for bags, rucksacks, items of clothing" (U.S.2004016089), describes a closure device composed of two identical components that stares at simplifying the production to that of a single component instead of two, without providing a closure mechanism with an explicit morphology such as the one of a "male-female" logo, so that there is no "male-female" distinction between them. Such two components attract each other and fit together without specific roles, being equal.

The patent document U.S.20020000024A1 describes various alternatives of a closure device formed by two components, one having a magnet and a tooth, the other having a second magnet and a slot corresponding to the said tooth, not generating a closure mechanism with an explicit and complex morphology like the one of a "male-female" logo.

The patent application for the invention U.S.20020112323A1 describes a closure device formed by two similar components, one having a fin with a magnet and a small pin in the exposed face, the other having a fin with a magnet and a small hole corresponding to the said pivot in the face behind, not generating a closure mechanism with an explicit and complex morphology like the one of a "male-female" logo.

The patent application for the invention U.S.20030131452A1 describes a closure device formed by two main complex components, one containing a slot and two rectangular magnets not visible from the outside, the other having a "male" component corresponding to the said slot and two rectangular magnets, not visible on the outside. These components do not provide a closure mechanism with an explicit and complex morphology like the one of a "male-female" logo.

The patent application U.S. Pat. No. 8,196,268B1 describes a closure device formed by two similar components, one having a cylindrical pin inclined 45°, the other a cylindrical bore also inclined 45° that receives the first, being both components coated with fabric on the visible faces. Also in this case those components of the patent do not provide a closure mechanism with an explicit and complex morphology like the one of a "male-female" logo.

SUMMARY OF THE INVENTION

State of the art analysis shows that there is a lack of a closure device formed by two parts different one another reversibly joined by means of "male-female" interlock and of magnetism, where the interpenetrating elements are able to convey a message as that of a logo and/or people's names initials through their complex outline, which is visible both when the device is open and closed. Such goal is believed to be highly desirable as in the case of a mark of an handbag.

Further characteristics and advantages of the invention will be apparent from the detailed description that follows referring to the attached figures, where the device makes use in the interlocking, by way of example and not as a limitation, of some stylized alphabetic characters, chosen among the possible shapes.

From the attached figures, it is possible to deduce the basic principles of the device: a magnetic interlocking closure device where the "male-female" components—different from each other and frontally interpenetrating—have a shape with complex outline such as that of a logo, which constrains the non-axial translation and the rotation of one component relative to the other, and such to allow only one closing angle with respect to the insertion axis. The same basic principles may give rise to shapes and sizes of the device that may be very different from those shown in the attached figures.

DETAILED DESCRIPTION OF THE INVENTION

Figure 1:
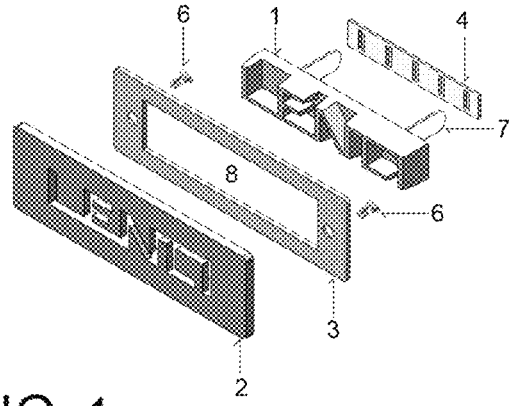
FIG. 1. is a three-dimensional exploded front view of the device.
Figure 4:
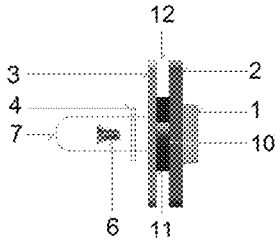
FIG. 4 is the left side elevation of the device.

With reference to the abovementioned figures, the magnetic interlocking closure device achieves the reversible adhesion of two surfaces of materials such as fabric, leather, leather-imitation, cardboard, wood, metallic, organic, mineral, ceramic, glass, or composite materials, or of a combination of them. Such reversible adhesion is achieved through the combined action of one or more magnets installed in one or more seats contained in the device, and of the interlock between its two main components: "male" 1 and "female" 2, as described below.

The "male" 1 has a shape with a complex outline, such as that of any logo, in relief, with a shape that allows it to penetrate frontally the inserting seat of the "female" 2. The "female" 2 presents the outline in negative of the "male" 1, to which a tolerance is added which is necessary to minimize the contact between the outlines of the two components. In the insertion and extraction phases, the sliding of the "male" component is bounded by the inner edge 11 of the "female" component 2. The geometry of the "male-female" joint is such to constrain the non-axial translation and the rotation of one component relative to the other, and such to allow only one closing angle with respect to the insertion axis. The "male" 1 is fixed, by way of example and not as a limitation, to the lower surface being closed by said device by fastening means 7, 4.

The "male" component/s 1 has/have, an embossment that allow/s it/them to protrude in relief, in closed status (FIG. 3), from the outer surface of the "female" component 2, so as to be clearly visible, and at the same time allows to easily open the device.

The "female" 2 is fixed to the upper surface being closed by said device by way of example and not as a limitation, by a counter-plate 3 connected it using fastening means 6. Such counter-plate 3 is hollow in its central part 8 to allow the "male" 1 penetration.

Between the "female" 2 and said counter-plate 3, except in those points where the seats 10 of the fastening means 6 are located, which by way of example and not as a limitation also serve as spacers 10 to hold at a desired distance 12 the "female" component 2 and the counter-plate 3, a slot 12 is formed that has a suitable thickness to clamp the upper one of the two overlapping surfaces being closed by said device.

By way of example and not as a limitation, the clamping of such surface is facilitated and stabilized by a lapel 13 toward the internal side located on the external edge of the "female" component 2.

Moreover, by way of example and not as a limitation, an internal border 11 of the "female" component 2 frames the counter-plate seat 3 and bounds the frontal translation seat of the "male" component 1.

Figure 2:
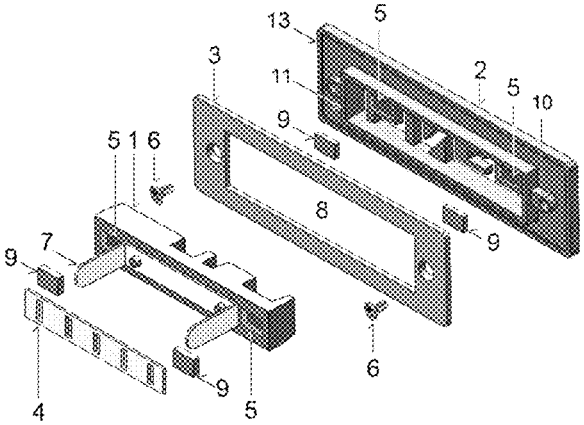
FIG. 2 shows, still in a three-dimensional exploded view, the backside of the device.
Figure 3:
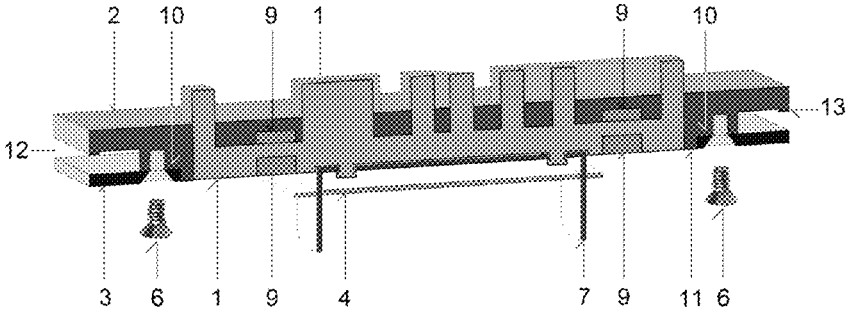
FIG. 3 is an axonometric-section view of the device.
Figure 5:
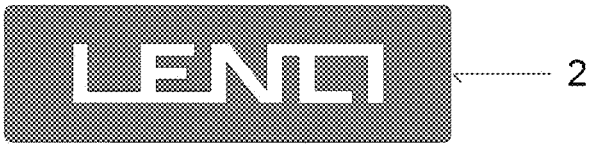
FIG. 5 is the front view of the "female" component.
Figure 6:
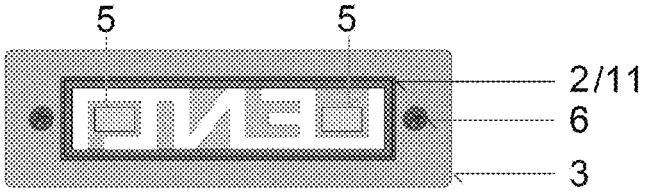
FIG. 6 is the rear elevation of the "female" component.
Figure 7:
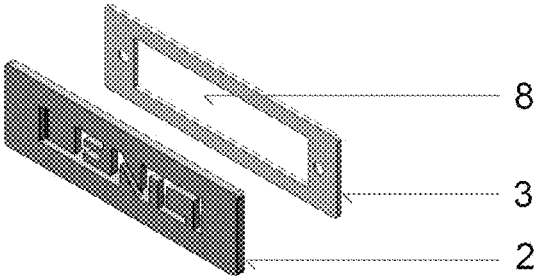
FIG. 7 shows the front of the "female" component in a three-dimensional exploded view.
Figure 8:
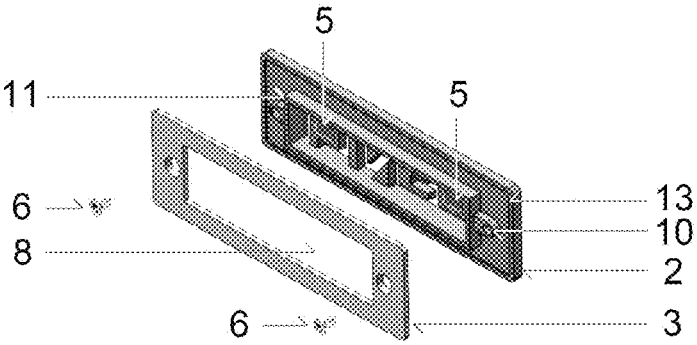
FIG. 8 shows the backside of the "female" component in a three-dimensional exploded view.
Figure 9:
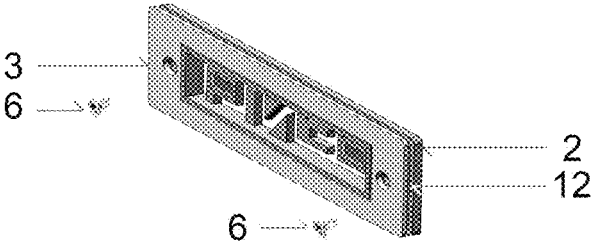
FIG. 9 shows the backside of the "female" component in a three-dimensional joint view.
Figure 10:
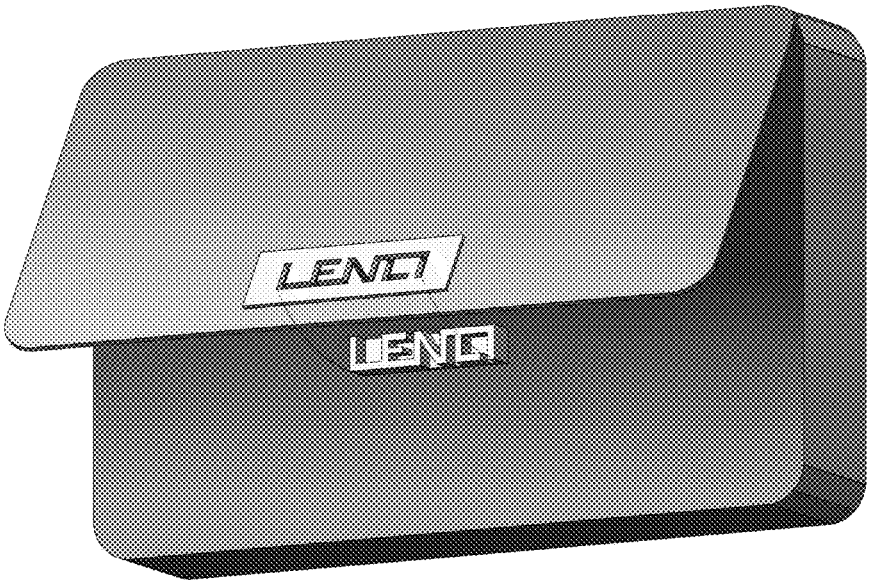
FIG. 10 shows the closure device installed on a opened bag.
Figure 11:
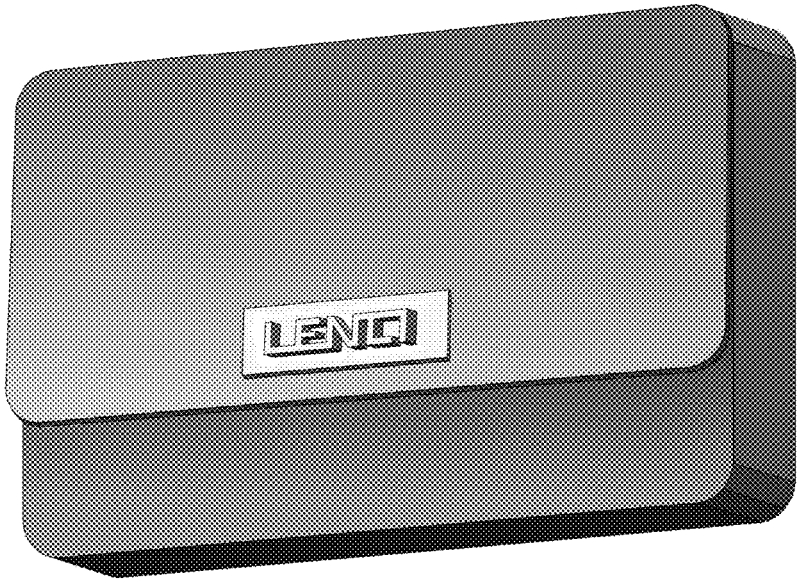
FIG. 11 shows the closure device installed on a closed bag.

The "male" 1 and "female" 2 are fixed to the surfaces being closed by the device in an overlapping position, in order to allow an easy interlock. Such interlock is guided and stabilized by the magnetic force exerted by one or more magnets 9. By way of example and not as a limitation, the magnets are housed in seats 5 located in the "female" 2, and/or in the "male" 1 component/s, in positions to exert an axial magnetic force. In the "male" 1, said seats can be located on its rear surface, in order not to be visible when the device is open (FIGS. 2 and 3). The Magnets may vary in number, shape and size, and they may also coincide with the "male" and/or "female" components themselves, or their parts thereof. The magnetic force may vary depending on the specific applications.

The opening of the device takes place by frontally sliding, the "female" component 2 through the "male" component 1, until the separation of the two parts is obtained, previously kept together by the combined action of the interlock and of the magnetic force.

The outline of the "male-female" interlock may have different shapes. By way of example and not as a limitation, such outline may form a name, an acronym, a brand, a logo, a single letter, the initials of a name, a cryptogram, a symbol, a drawing.

The outer edge of the "female" component 2 may have any shape, such as, by way of example and not as a limitation, a rectangle, a square, a circle, a triangle, a polygon, an oval, or a fantasy shape.

The size of the device may vary depending on the application and on the required visibility of the represented figure. Being the closure force dependent on the attractive force of the magnets, the size of the device may also depend on the space needed for their sockets.

The materials used to build the device can be metallic, organic, mineral, ceramic, glass, composite, or a combination of those.

LEGEND OF NUMBERS

1—"male" component;
2—"female" component;
3—counter-plate of the "female" component;
4—slotted plate fixing the "male" component to the support;
5—blind seat for magnet;
6—fastening means fixing the counter-plate to the plate of the "female" component;
7—means fixing the "male" component/s;
8—empty central portion of the counter-plate of the "female" component;
9—magnet;
10—fastening means seat, and also spacer for the counter-plate of the "female" component;
11—inner edge of the "female" component;
12—slot of the "female" component clamping the support;
13—border in relief of the "female" component that stabilizes the clamping of the support.

The invention claimed is:

1. A magnetic interlocking closure device, for bags, other containers and apparel, comprising:

a first component and a second component, the first and second components being different from each other with the first component being a male component and the second component being a female component, wherein the first component penetrates into the second component;

one or more magnets that, in a fastening configuration, magnetically fasten, in a plane of contact, the first component to the second component with the first component penetrating into the second component, the one or more magnets being installed into seats located in at least one of the first and second components, wherein the first component includes a first side and an opposite second side, the first side of the first component having a first surface and a protrusion that protrudes from the first surface of the first side of the first component, the protrusion being a male element and having a shape defining an outline defined by concave angles and/or convex angles and/or curves, the outline able to reproduce in positive a shape of a logo or a combination of letters, wherein the second component is a plate with a first side, an opposite second side, and an opening that extends through the second component from the first side to the second side of the second component, the opening being a female element, and the opening having outline that defines a shape that is a negative of the shape of the outline of the protrusion that reproduces in negative the same logo or the same combination of letters as reproduced by the outline of the protrusion, wherein in the fastened configuration with the first side of the first component facing the first side of the second component, a volume of said protrusion sticks out in relief from the opening of the second component, so that, both in the closed configuration of the closure device, as in an open configuration of the first and second components of the device, said logo or said combination of letters can always be readable and/or recognizable, wherein said first component is free of any opening that extends through the first component from the first side to the second side of the first component, and, in the fastening configuration acts as another female element, and said second component is free of any protrusion that protrudes from the first side of the second component, and, in the fastening configuration acts as another male element.

2. The magnetic interlocking closure device according to claim 1, wherein said seats, for the magnets installed, are located in the second face of the first component, and wherein no magnet is visible when the device is installed.

3. The magnetic interlocking closure device according to claim 1, wherein said seats, for the magnets installed, are located in the first face of the second component, and wherein no magnet is visible when the device is installed and closed.

4. The magnetic interlocking closure device according to claim 1, wherein the first side of said second component comprises a lapel (13) clamping the material on which the second component is installed.

5. The magnetic interlocking closure device according to claim 2, wherein said seats, for the magnets installed, are located in the first face of the second component, and wherein no magnet is visible when the device is installed and closed.

6. The magnetic interlocking closure device according to claim 1, further comprising a counter-plate (3) fixed to the first side of the second component, the counter-plate (3) including an inside perimeter that defines a central opening, wherein, in the fastening configuration, the central opening surrounds an outside perimeter of the first component.

7. The magnetic interlocking closure device according to claim 6, wherein the second side of the first component includes a fastening element (7) for installing the first component on a face of the bags, other containers, and apparel.

8. The magnetic interlocking closure device according to claim 6, wherein said seats, for the magnets installed, are located in the second face of the first component, and wherein no magnet is visible when the device is installed.

9. The magnetic interlocking closure device according to claim 6, wherein said seats, for the magnets installed, are located in the first face of the second component, and wherein no magnet is visible when the device is installed and closed.

10. The magnetic interlocking closure device according to claim 6, wherein the first side of said second component comprises a lapel that clamps the material on which the second component is installed, the lapel protruding from the first side of the second component, an outside perimeter of said lapel being adjacent the inside perimeter of the counter-plate (3).

11. The magnetic interlocking closure device according to claim 8, wherein said seats, for the magnets installed, are located in the first face of the second component, and wherein no magnet is visible when the device is installed and closed.

12. A magnetic interlocking closure device, for bags, other containers and apparel, comprising:

a first component and a second component, the first and second components being different from each other in that the first component is a male component and the second component is a female component, wherein, in a fastening configuration, the first component penetrates into the second component;

one or more magnets that, in the fastening configuration, magnetically fasten, in a plane of contact, the first component to the second component with the first component penetrating into the second component, the one or more magnets being installed into seats located in at least one of the first and second components, wherein the first component includes a first side and an opposite second side, the first side of the first component having a first surface and a protrusion that protrudes from the first surface of the first side of the first component, the protrusion being a male element and having a shape defining an outline defined by concave angles and/or convex angles and/or curves, the outline able to reproduce in positive a shape of a logo or a combination of letters, wherein the second component is a plate with a first side, an opposite second side, and an opening that extends through the second component from the first side to the second side of the second component, the opening being a female element, and the opening having outline that defines a shape that is a negative of the shape of the outline of the protrusion that reproduces in negative the same logo or the same combination of letters as reproduced by the outline of the protrusion, wherein in the fastened configuration with the first side of the first component facing the first side of the second component, a volume of said protrusion sticks out in relief from the opening of the second component, so that, both in the closed configuration of the closure device, as in an open configuration of the first and second components of the device, said logo or said combination of letters can always be readable and/or recognizable;

a counter-plate (3) fixed to the first side of the second component, the counter-plate (3) including an inside perimeter that defines a central opening, wherein, in the fastening configuration, the central opening surrounds an outside perimeter of the first component.

13. The magnetic interlocking closure device according to claim 12, wherein the second side of the first component includes a fastening element (7) for installing the first component on a face of the bags, other containers, and apparel.

14. The magnetic interlocking closure device according to claim 12, wherein said seats, for the magnets installed, are located in the second face of the first component, and wherein no magnet is visible when the device is installed.

15. The magnetic interlocking closure device according to claim 12, wherein said seats, for the magnets installed, are located in the first face of the second component, and wherein no magnet is visible when the device is installed and closed.

16. The magnetic interlocking closure device according to claim 12, wherein the first side of said second component comprises a lapel that clamps the material on which the second component is installed, the lapel protruding from the first side of the second component, an outside perimeter of said lapel being adjacent the inside perimeter of the counter-plate (3).

17. The magnetic interlocking closure device according to claim 14, wherein said seats, for the magnets installed, are located in the first face of the second component, and wherein no magnet is visible when the device is installed and closed.

18. The magnetic interlocking closure device according to claim 12, wherein the first side of said second component comprises a lapel that clamps the material on which the second component is installed, an outside perimeter of said lapel being adjacent the inside perimeter of the counter-plate (3).

* * * * *